US005155296A

United States Patent [19]

Michaluk

[11] Patent Number: 5,155,296

[45] Date of Patent: Oct. 13, 1992

[54] THERMALLY ENHANCED WARHEAD

[75] Inventor: Christopher Michaluk, Warminster, Pa.

[73] Assignee: The United States of America as represented by The Secretary of the Army, Washington, D.C.

[21] Appl. No.: 853,554

[22] Filed: Mar. 18, 1992

[51] Int. Cl.[5] ..... F42B 12/10

[52] U.S. Cl. ..... 102/476; 102/501

[58] Field of Search ..... 102/476, 501, 306-310

[56] References Cited

U.S. PATENT DOCUMENTS

| | | | |
|---|---|---|---|
| 4,590,861 | 5/1986 | Bugiel | 102/501 |
| 4,784,062 | 11/1988 | Rudolf et al. | 102/476 |
| 4,979,443 | 12/1990 | Rittel et al. | 102/307 |
| 5,033,387 | 7/1991 | Lips | 102/476 |

*Primary Examiner*—Charles T. Jordan

*Attorney, Agent, or Firm*—Anthony T. Lane; Edward Goldberg; Michael C. Sachs

[57] ABSTRACT

A thermally enhanced warhead utilizes a heated tungsten liner to generate an explosively formed high velocity coherent molten slug to defeat armor targets.

9 Claims, 1 Drawing Sheet

THERMALLY ENHANCED WARHEAD

GOVERNMENTAL INTEREST

The invention described herein may be manufactured, used and licensed by or for the Government for Governmental purposes without the payment of any royalty thereon.

BACKGROUND OF THE INVENTION

The improvement in armor for tanks, personnel carriers, and armor protected fortified positions has necessitated the use of projectile warheads having liners which are capable of penetrating and defeating these targets. In the past the election of materials used for explosively formed penetrator (EFP) warheads has been limited to those which experience a high degree of ductility at ambient temperatures. Although EFP warheads using copper and iron liners can successfully form into a high velocity lethal slug under the influence of an explosive shock wave, tantalum is considered the material of choice because of its high density. The problem with the use of tantalum is that it is extremely expensive. In the past, even though tungsten had the high density desired for use as an explosively formed penetrator, its inherent brittleness at ambient temperature prevented it from forming into a coherent lethal slug after detonation.

The armament research community in its attempt to improve the mechanical properties of less expensive alternate materials, have made advances in tungsten processing which has enabled tungsten's ductile-to-brittle transition temperature to be reduced to around 350° F. The present invention describes how this improved tungsten material can be incorporated into an integrated lethal mechanism and perform effectively as an EFP warhead.

SUMMARY OF THE INVENTION

The present invention relates to a thermally enhanced warhead which utilizes a tungsten liner to form a high velocity coherent lethal slug capable of penetrating armored targets.

An object of the present invention is to provide an explosively formed penetrator for a shaped charged warhead which has a density greater than either copper or iron.

Another object of the present invention is to provide an explosively formed penetrator for a shaped charged warhead wherein the liner material is cheaper than tantalum.

A further object of the present invention is to provide a shaped charge warhead which can utilize tungsten, which has been processed so that its ductile-to-brittleness temperature has been reduced to around 350° F., as a liner capable of forming a high velocity coherent lethal slug.

For a better understanding of the present invention, together with other and further objects thereof, reference is made to the following description taken in connection with the accompanying drawings.

BRIEF DESCRIPTION OF THE DRAWINGS

Throughout the following description, like reference numerals are used to denote like parts of the drawings.

DETAILED DESCRIPTION OF THE PREFERRED EMBODIMENTS

Figure 2:
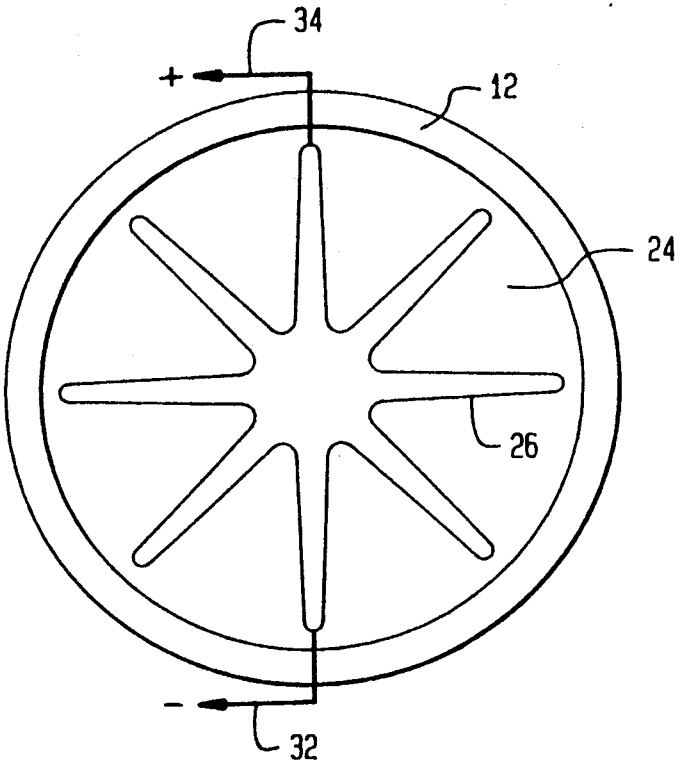
FIG. 2 is a side view taken along line 2—2 of FIG. 1.
Figure 1:
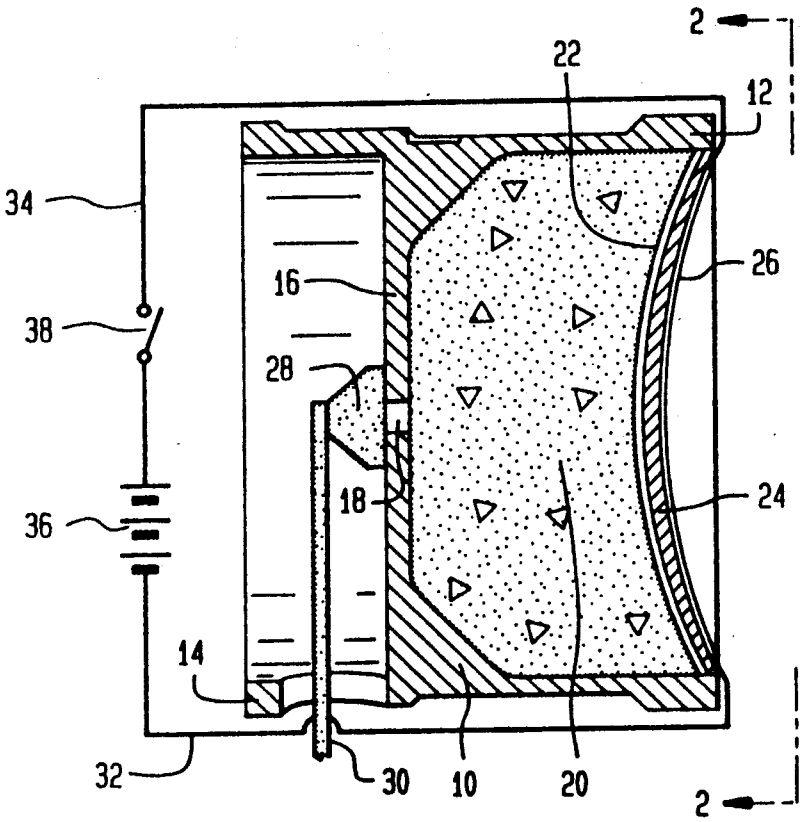
FIG. 1 is a diametrical cross-sectional view of the explosively formed warhead.

Referring now to FIGS. 1 and 2, a cylindrical submunition housing 10 has a counter bored front end 12, a counter-bored rear end 14, and a wall separator 16 having a axial hole 18 therein which communicate with front end 12 and the rear end 16. The front housing end 12 is partially filled with an explosive billet 20. The front concave end of the billet 20 is in intimate contact with spherically shaped insulator member 22.

In juxtaposition with the insulator member 22 is a spherically shaped improved tungsten EFP liner 24. A symmetrical star shaped resistance heating element 26 is in intimate contact with the outer concave surface of the liner 24. The housing rear end 14 contains a detonator 28 which is operatively positioned in axial alignment with wall separator axial hole 18. A firing train 30 passes through rear end housing 14 and is connected proximate to detonator 28. Heating element 26 is electrically connected by electrical conductors 32 and 34 to a battery 36 through a normally open single pole switch 38.

In operation, an independent event such as gun launch or ground detection by sensors, not shown, triggers the electrical switch 38 causing it to close, allowing electrical current generated by battery 36 to flow through the electrical leads 32 and 34 and through the resistance heating element 26. The resistance heating element 26 compound of nichrome wire with a microthin layer of high electrical resistance material increases in temperature. Heat, but not electrical current, is transferred from the heating element 26 to the tungsten liner 24 by means of conduction. The temperature of the liner 24 is increased above its ductile-to-brittle temperature of approximately 350° F., enabling the liner 24 to function in a ductile manner. The insulator 22 prevents the heat from the liner 24 from affecting the explosive billet 20 and causing a premature detonation. The insulator 22 is composed of a low density, high resistance polymer with an impedance value close to that of the explosive billet 20. A second independent event, such as target detection by a sensor, not shown, results in a firing pulse being sent which initiates the propellant in the firing train 30 which fires the detonator 28 which in turn detonates the explosive billet 20 through hole 18. The explosive shock wave, confined by the housing 10 deforms the hot tungsten liner 24 into a lethal penetrator while propelling it toward a target.

Because of the velocity, density and heat of the slug, the tungsten EFP impacts and defeats the target.

While a specific embodiment of the invention has been shown and described in detail to illustrate the application of the principles of the invention, it will be understood that the invention may be embodied otherwise without departing from said principles.

What is claimed is:

1. A thermally enhanced warhead which comprises;

a housing having a counterbored front end a counterbored rear end, and a wall separator member intermediate said front end and said rear end, said wall separator having an axial hole therein allowing communication between said front end and said rear end;

explosive means operatively disposed in said housing front end in juxtaposition with said wall separator for generating an explosive shock wave;

insulator means positioned in contact with said explosive means for preventing heat through said insulator means from prematurely detonating said explosive means;

liner means operatively disposed in abutment with said insulator means for generating a lethal high velocity molten slug when subjected to said shock wave;

heater means operatively positioned against said liner means for raising the temperature of said liner means above its ductile-to-brittle range;

igniter means for initiating said explosive means; and power means for providing electrical energy to said heater means; and switch means for transferring energy from said power means to said heater means.

2. A thermally enhanced warhead as recited in claim 1 wherein said explosive means includes an explosive billet having a concave contoured front end.

3. A thermally enhanced warhead as recited in claim 2 wherein said insulator means includes a spherically shaped low density high resistance polymer with an impedance value close to the impedance value of said explosive billet.

4. A thermally enhanced warhead as recited in claim 3 wherein said liner means includes;

a spherically shaped tungsten member having a ductile-to-brittle temperature range of approximately 350° F.

5. A thermally enhanced warhead as recited in claim 3 wherein said heater means includes;

a nichrome wire with a microthin layer of high electrical resistance.

6. A thermally enhanced warhead as recited in claim 5 wherein said igniter means includes;

a detonator positioned proximate to said housing wall separator and in axial alignment with said axial hole in said wall separator; and a firing train proximate to said detonator for initiating said detonator.

7. A thermally enhanced warhead as recited in claim 6 wherein said power means includes:

a battery electrically connected to said heater means through electrical conductors.

8. A thermally enhanced warhead as recited in claim 7 wherein said switch means includes;

a normally open single pole single throw switch for connecting said battery to said heater means upon receipt of a fire signal.

9. A thermally enhanced warhead as recited in claim 8 wherein heater means includes a symmetrical star shaped nichrome wire element having an electrical insulating coating thereon.

* * * * *